US005094364A

United States Patent [19]

Knickerbocker

[11] Patent Number: 5,094,364

[45] Date of Patent: Mar. 10, 1992

[54] PROTECTIVE OVERCAP AND WIPER FOR DISPENSER DISCHARGE ORIFICE

[75] Inventor: Michael G. Knickerbocker, Upland, Calif.

[73] Assignee: Calmar Inc., Watchung, N.J.

[21] Appl. No.: 538,736

[22] Filed: Jun. 15, 1990

[51] Int. Cl.[5] ..... B67D 5/00

[52] U.S. Cl. ..... 222/148; 222/321; 222/342

[58] Field of Search ..... 222/148, 149, 182, 321, 222/342, 402.11, 402.12, 545, 562, 383; 239/115, 123

[56] References Cited

U.S. PATENT DOCUMENTS

| | | | |
|---|---|---|---|
| 3,655,100 | 4/1972 | Markowitz | 222/182 |
| 4,122,977 | 10/1978 | Butcher | 222/182 |
| 4,437,591 | 3/1984 | von Schuckmann | 222/405 |
| 4,903,868 | 2/1990 | Ichihara et al. | 222/387 |
| 4,944,458 | 7/1990 | Sassenberg | 222/545 |

FOREIGN PATENT DOCUMENTS

| | | | |
|---|---|---|---|
| 94764 | 11/1983 | European Pat. Off. | 222/386 |
| 277893 | 8/1988 | European Pat. Off. | 222/207 |

*Primary Examiner*—Kevin P. Shaver
*Assistant Examiner*—Philippe Derakshini
*Attorney, Agent, or Firm*—Watson, Cole, Grindle & Watson

[57] ABSTRACT

A removable overcap for a finger actuated pump dispenser surround the plunger head and is frictionally mounted in place on the pump body. An upper portion of the overcap side wall bears against an orifice cup located in the head, the cup containing a discharge orifice through which product is dispensed with the overcap removed. In conditions of non-use, the overcap covers the orifice to prevent drying of product. And, the overcap wipes the orifice clean of any accumulated product each time the overcap is removed and reapplied over the dispenser.

1 Claim, 1 Drawing Sheet

PROTECTIVE OVERCAP AND WIPER FOR DISPENSER DISCHARGE ORIFICE

BACKGROUND OF THE INVENTION

This invention relates generally to a manually operated fingertip dispenser having a reciprocable plunger head containing a discharge orifice through which product is dispensed upon head reciprocation. More particularly, the invention relates to a removable protective overcap overlying the plunger head and pump body in a condition of non-use wherein the overcap covers the orifice to prevent drying of the product. Upon removal of the overcap, the dispenser may be operated as in the normal manner. And, upon reapplication of the overcap after removal, the overcap functions to wipe the orifice clean of any accumulated dried product.

Manually actuated pump dispensers are well known for disPensing a variety of products upon finger actuation of a Plunger head which reciprocates the pump piston traveling within a pump cylinder for pressurizing the product and discharging it through a discharge orifice located in the head which terminates in a discharge orifice. The products to be dispensed, as by spraying, include hair sprays and other resinous containing materials which, upon drying, upon exposure to the atmosphere, tend to clog the spray discharge orifice. Clogging interferes with the free flow of discharge by causing sputtering and uneven spray patterns.

Protector caps and covers have been devised to prevent the drying out of the discharged material in the discharge spout or orifice and to prevent its contamination. The known caps and covers employed for this purpose are, however, rather cumbersome, difficult to operate, and are costly to fabricate. Moreover, they are so structured as to render them unwieldy and unattractive and oftentimes impractical.

SUMMARY OF THE INVENTION

It is therefore an object of the present invention to provide a removable overcap for such a finger actuated pump dispenser, the overcap covering the discharge orifice to prevent drying of product, and the overcap serving to wipe the orifice of any accumulated product upon removal and reapplication of the overcap in place.

In a dispenser condition of non-use, the overcap surrounds the plunger and frictionally engages a portion of the pump body. The discharge orifice is located in an orifice cup mounted in the cylindrical side wall of the plunger head. A portion of the overcap bears against the orifice cup in the non-use condition for covering the orifice to prevent drying of product and for wiping the orifice of any accumulated product each time the overcap is removed and reapplied.

The orifice cup may extend outwardly of the plunger head side wall.

Other objects, advantages and novel features of the invention will become more apparent from the following detailed description of the invention when taken in conjunction with the accompanying drawings

DETAILED DESCRIPTION OF THE INVENTION

Figure 1:
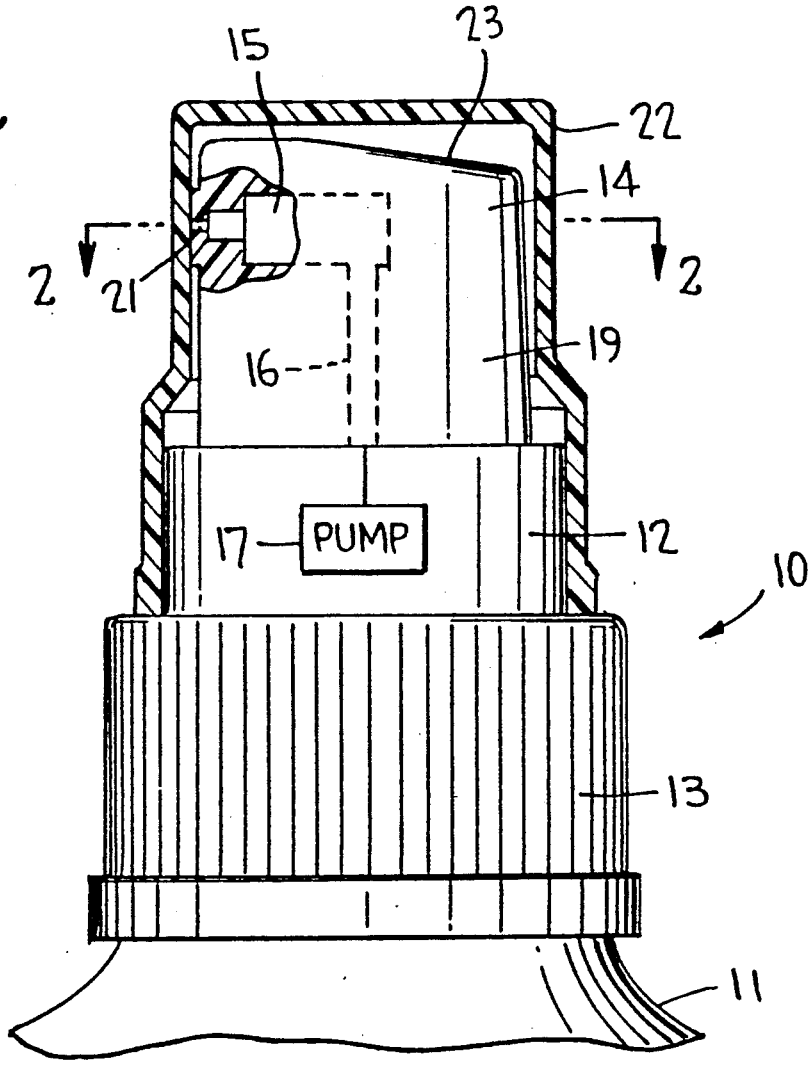
FIG. 1 is a side elevational view of a finger actuated pump dispenser showing the sectioned overcap of the invention mounted in place.

Turning now to the drawings wherein like reference characters refer to like and corresponding parts throughout the several views, a finger actuated pump dispenser, generally designated 10 in FIG. 1, is shown mounted on the neck of a container 11 of product to be dispensed. The dispenser includes an upstanding sleeve 12 surrounded bY an internally threaded closure 13 for mounting on the container neck. A reciprocable plunger head 14 is mounted for reciprocation relative to the sleeve, and contains a discharge passage 15 in engagement with a hollow plunger 16 having a pump piston at its inner end which reciprocates in a pump cylinder (together designated "pump" 17) for dispensing product from a pump chamber defined by the piston and cylinder during each pressure stroke of the piston. The dispenser structure and operation is well known in this art, and forms no part of the invention..

Figure 2:
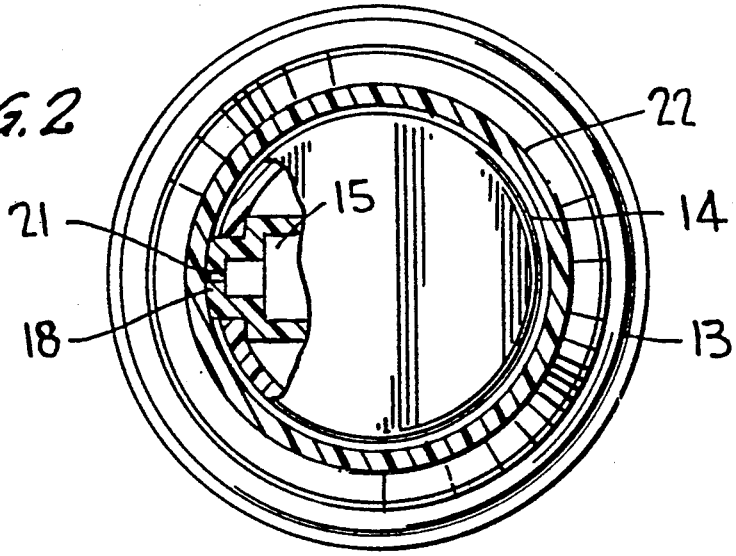
FIG. 2 is a sectional view taken substantially along the line 2—2 of FIG. 1.

An orifice cup 18, which may be separate from or integral with discharge passage 15, is mounted in side wall 19 of the plunger head, the cup containing a discharge orifice 21 in communication with the discharge passage through which product issues upon plunger reciprocation. The orifice cup may be flush with side wall 19 of the plunger head, or may extend slightly outwardly thereof as shown in FIGS. 1 and 2.

In accordance with the invention, a removable overcap 22 surrounds the plunger head and frictionally engages the sleeve 22 in the non-use condition of the dispenser shown in FIG. 1. The overcap has a slightly reduced diameter at its upper portion dimensioned to bear against orifice cup 18 in the non-use condition shown. Thus, with the overcap in place, it covers the orifice to prevent drying of product at the discharge orifice when the dispenser is stored or shelved or during other conditions of non-use. The operator simply removes the overcap from the dispenser for operation of the plunger head upon application of finger force to the top wall 23 thereof, as in the normal manner known in this art. After use, the operator simply reapplies the overcap to the dispenser for again covering the orifice to prevent drying. Each time the overcap is removed, it simply wipes the orifice clean of any accumulated product as the overcap slides against the orifice cup and its orifice.

Obviously, many modifications and variations of the present invention are made possible in the light of the above teachings. It is therefore to be understood that within the scope of the appended claims the invention may be practiced otherwise than as specifically described

What is claimed is:

1. A manually actuated pump sprayer comprising a pump body which includes a closure for mounting the body on a container of liquid product to be sprayed, the pump body having a piston and cylinder defining a pump chamber, an upstanding sleeve of a predetermined diameter on said closure, a plunger head of a diameter less than said predetermined diameter telescoped within said sleeve for manual reciprocation, means defining a discharge passage extending from said pump chamber to a lateral discharge spray orifice through which liquid product is sprayed upon plunger reciprocation, said plunger head having an orifice cup in communication with said passage and mounted in a side wall of said head, said cup having an outer wall extending slightly outwardly of said side wall, and said outer wall containing said discharge orifice, a removable overcap surrounding said plunger head and said sleeve, said overcap having a lower diameter substantially equal to said predetermined diameter for frictionally engaging said sleeve in a non-use condition of the sprayer, and said overcap having an upper diameter less than said lower diameter and slightly greater than said head diameter for bearing tightly against said outer wall of said orifice cup in said non-use condition for covering said orifice to prevent drying of the liquid product at said spray orifice, and for wiping said orifice and said outer wall of any accumulated liquid product each time the overcap is removed and reapplied.

* * * * *